US012110612B2

(12) United States Patent
Stanishevsky et al.

(10) Patent No.: US 12,110,612 B2
(45) Date of Patent: Oct. 8, 2024

(54) ALTERNATING FIELD ELECTRODE SYSTEM AND METHOD FOR FIBER GENERATION

(71) Applicant: THE UAB RESEARCH FOUNDATION, Birmingham, AL (US)

(72) Inventors: Andrei V. Stanishevsky, Birmingham, AL (US); William Anthony Brayer, Maylene, AL (US)

(73) Assignee: THE UAB RESEARCH FOUNDATION, Birmingham, AL (US)

( * ) Notice: Subject to any disclaimer, the term of this patent is extended or adjusted under 35 U.S.C. 154(b) by 462 days.

(21) Appl. No.: 17/429,986

(22) PCT Filed: Feb. 14, 2020

(86) PCT No.: PCT/US2020/018407

§ 371 (c)(1),
(2) Date: Aug. 11, 2021

(87) PCT Pub. No.: WO2020/168272

PCT Pub. Date: Aug. 20, 2020

(65) Prior Publication Data

US 2022/0145495 A1 May 12, 2022

Related U.S. Application Data

(60) Provisional application No. 62/805,431, filed on Feb. 14, 2019.

(51) Int. Cl.
*D01D 5/00* (2006.01)

(52) U.S. Cl.
CPC ..... *D01D 5/0092* (2013.01); *D01D 5/0069* (2013.01)

(58) Field of Classification Search
CPC ..... D01D 5/0069; D01D 5/0092
See application file for complete search history.

(56) References Cited

U.S. PATENT DOCUMENTS 8,211,352 B2 7/2012 Baca
10,588,734 B2 * 3/2020 MacEwan ..... B29C 48/02
(Continued)

FOREIGN PATENT DOCUMENTS

CN 102709555 A 10/2012
CN 105008600 A 10/2015
(Continued)

OTHER PUBLICATIONS

First Office Action for CN202080013987.4 mailed Aug. 12, 2022.
(Continued)

*Primary Examiner* — Emmanuel S Luk
(74) *Attorney, Agent, or Firm* — Thomas | Horstemeyer, LLP

(57) ABSTRACT

An electrode system for use in an AC-electrospinning process comprises an electrical charging component electrode and at least one of an AC field attenuating component and a precursor liquid attenuating component. The electrical charging component electrode is electrically coupled to an AC source that places a predetermined AC voltage on the electrical charging component electrode. In cases in which the electrode system includes the AC field attenuating component, it attenuates the AC field generated by the electrical charging component electrode to better shape and control the direction of the fibrous flow. In cases in which the electrode system includes the precursor liquid attenuating component, it serves to increase fiber generation, even if the top surface of the liquid precursor is not ideally shaped or is below a rim or lip of the reservoir that contains the liquid on the electrical charging component electrode.

21 Claims, 7 Drawing Sheets

(56) References Cited

U.S. PATENT DOCUMENTS

| | | | | |
|---|---|---|---|---|
| 10,941,040 | B2 * | 3/2021 | Lima | D01D 5/42 |
| 2001/0046599 | A1 * | 11/2001 | Kelly | B05B 5/10 264/10 |
| 2009/0038628 | A1 | 2/2009 | Shen | |
| 2010/0038830 | A1 | 2/2010 | Lahann | |
| 2010/0072674 | A1 * | 3/2010 | Takahashi | D01D 5/0069 977/840 |
| 2010/0148404 | A1 * | 6/2010 | Smida | D02G 3/36 425/66 |
| 2011/0018174 | A1 * | 1/2011 | Baca | D01D 5/0092 425/174.8 E |
| 2011/0148006 | A1 * | 6/2011 | Nagayama | D04H 1/728 264/465 |
| 2011/0180951 | A1 * | 7/2011 | Teo | D01D 5/0046 264/109 |
| 2011/0278751 | A1 * | 11/2011 | Ishikawa | D01D 5/0069 977/840 |
| 2012/0056342 | A1 * | 3/2012 | Koslow | B01F 23/45 425/8 |
| 2012/0242010 | A1 * | 9/2012 | Ishikawa | D01D 5/0076 264/479 |
| 2014/0134240 | A1 | 5/2014 | Kaplan | |
| 2015/0315724 | A1 | 11/2015 | Kocis et al. | |
| 2016/0168755 | A1 * | 6/2016 | Toyoda | D01D 5/0092 425/72.2 |
| 2018/0371645 | A1 * | 12/2018 | Beran | D01D 5/003 |
| 2019/0338445 | A1 * | 11/2019 | Haff | D01D 5/0092 |
| 2020/0122169 | A1 * | 4/2020 | Sugawara | B05B 5/025 |
| 2020/0156945 | A1 * | 5/2020 | Holmberg | D01F 1/10 |
| 2021/0222327 | A1 * | 7/2021 | Beran | D01D 5/0069 |

FOREIGN PATENT DOCUMENTS

| | | | |
|---|---|---|---|
| CN | 106917147 | A | 7/2017 |
| CN | 108603308 | A | 9/2018 |
| CN | 109097849 | A | 12/2018 |
| CN | 202725378 | U | 8/2020 |
| GB | 543358 | A | 2/1942 |
| JP | 2009013535 | A | 1/2009 |
| JP | 4837627 | B2 | 12/2011 |
| KR | 20120050277 | A | 5/2012 |
| WO | 2005024101 | A1 | 3/2005 |
| WO | 2008106381 | A2 | 4/2008 |
| WO | 2009102365 | A3 | 8/2009 |
| WO | 2014094694 | A1 | 6/2014 |
| WO | 2016163650 | A1 | 10/2016 |
| WO | 2017108012 | A1 | 6/2017 |

OTHER PUBLICATIONS

First Office Action for CN202080013987.4 mailed Oct. 28, 2023.
International Search Report for PCT/US20/18407 mailed May 7, 2020.
Stanishevsky, et al., "Nanofibrous alumina structures fabricated using high-yield alternating current electrospinning".
EP Search opinion for 20755656.4 / 3924541 PCT/US2020018407 mailed Apr. 6, 2023.

* cited by examiner

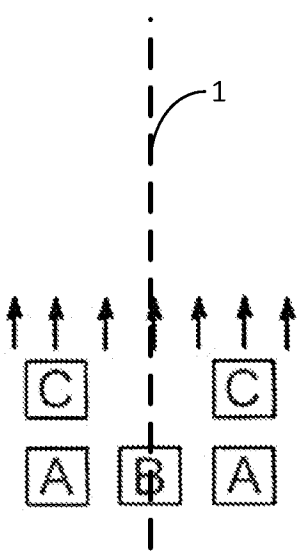
FIG. 3
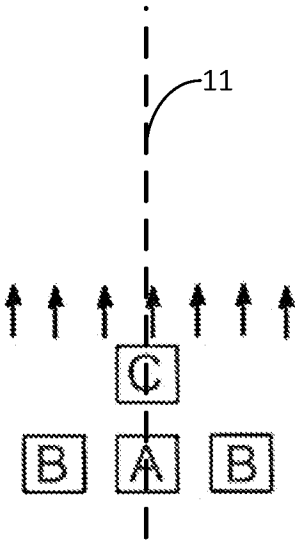
FIG. 4
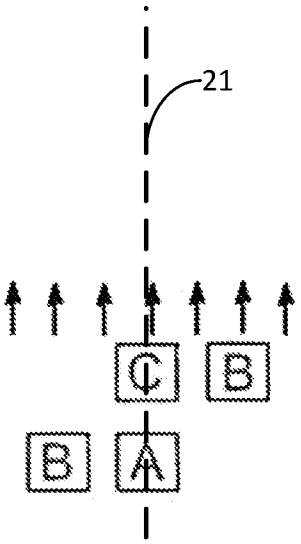
FIG. 5
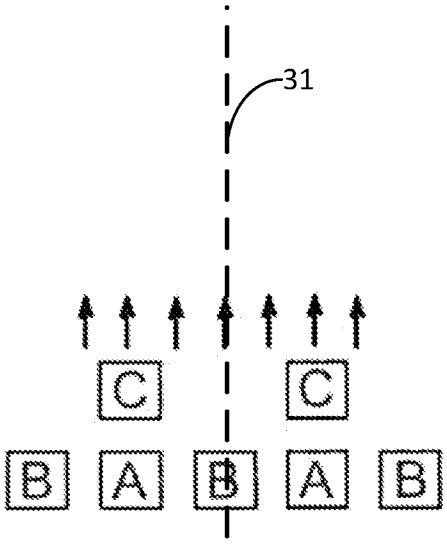
FIG. 6
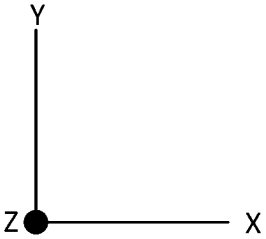

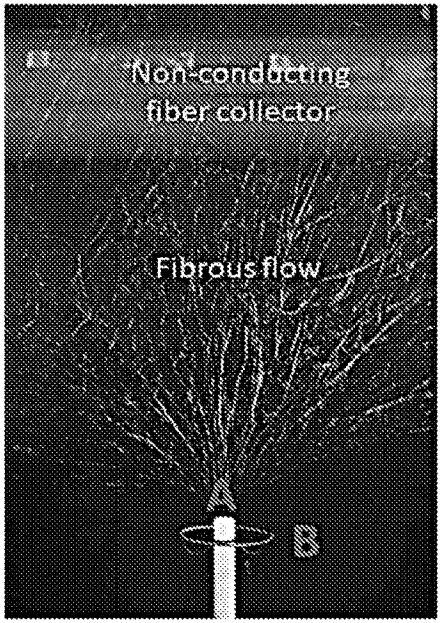
FIG. 7A
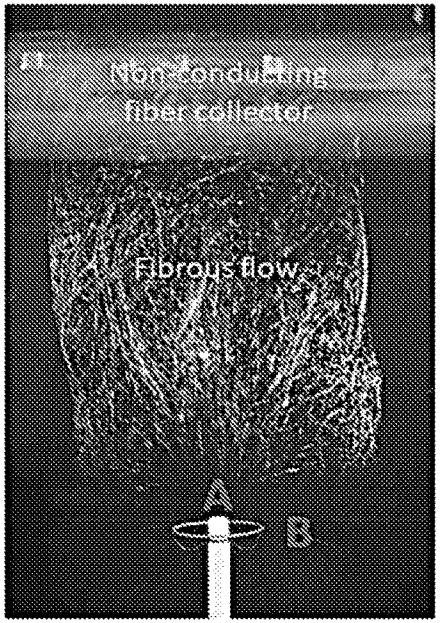
FIG. 7B
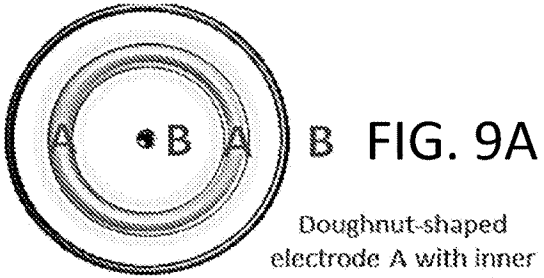
Doughnut-shaped electrode A with inner and outer electrode B
FIG. 9A
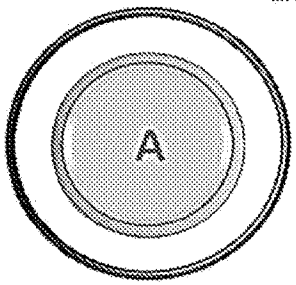
Disk-shaped electrode A with outer electrode B
FIG. 9B
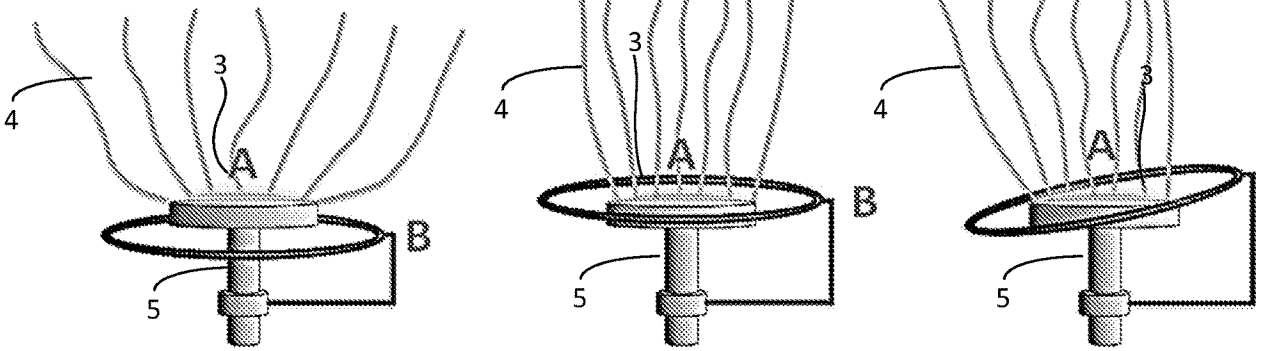
FIG. 8A
FIG. 8B
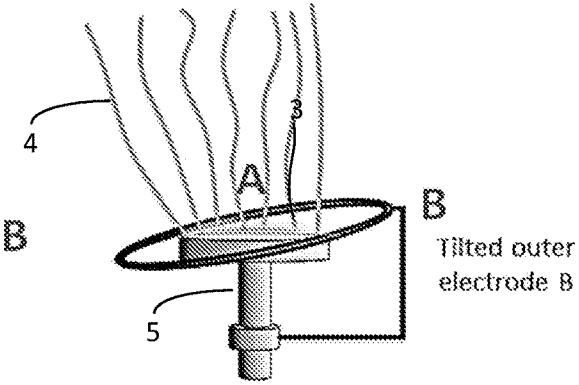
FIG. 10
Same AC voltage is supplied to both the fluid-loaded electrode A and field attenuating electrode B

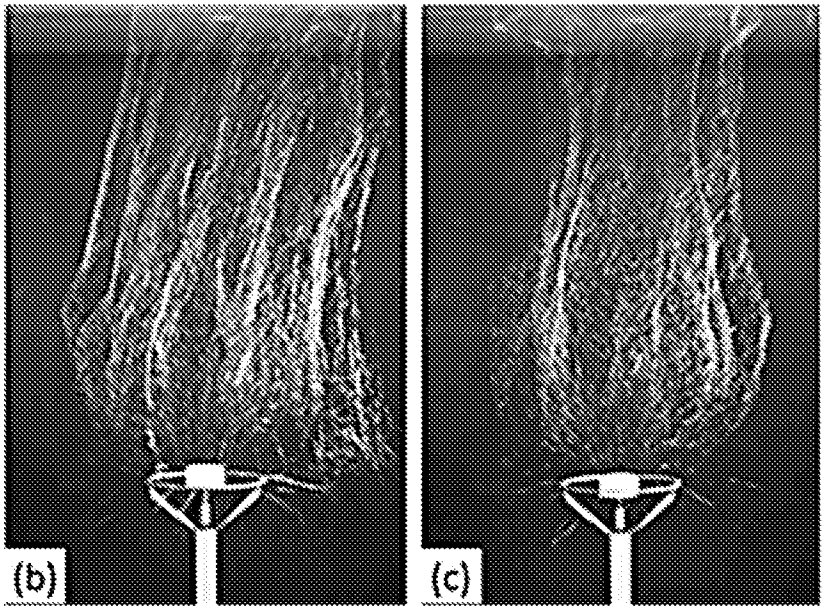
FIG. 11C
FIG. 11B
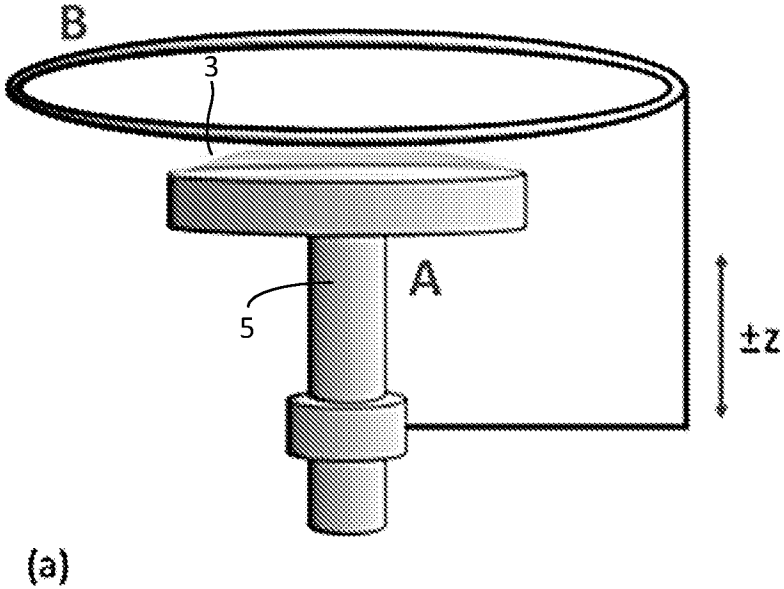
FIG. 11A

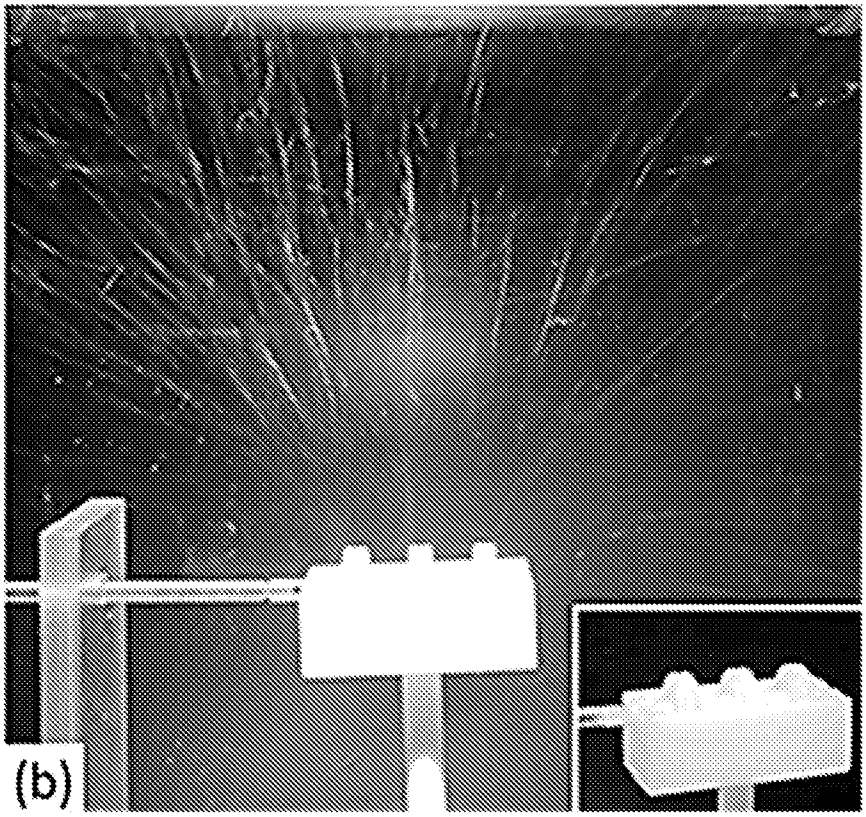
FIG. 12B
FIG. 12C
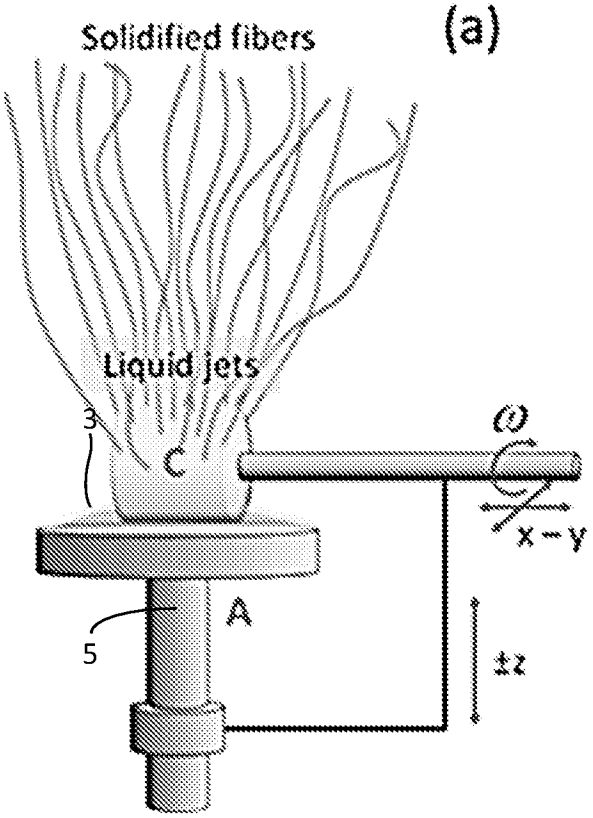
FIG. 12A

ALTERNATING FIELD ELECTRODE SYSTEM AND METHOD FOR FIBER GENERATION

CROSS-REFERENCE TO RELATED APPLICATIONS

The present application is a national stage entry pursuant to 35 U.S.C. § 371 of International Patent Application No. PCT/US2020/018407, filed on Feb. 14, 2020, which claims the benefit of, and priority to, the filing date of U.S. provisional application Ser. No. 62/805.431, filed on Feb. 14, 2019, both of which are hereby incorporated by reference herein in their entireties.

TECHNICAL FIELD OF THE INVENTION

This invention relates to fiber generation, and more particularly, to an alternating field electrode system and method for use in generating fibers via electrospinning.

BACKGROUND OF THE INVENTION

Electrospinning is a process used to make micro-fibers and nano-fibers. In electrospinning, fibers are usually made by forcing a polymer-based melt or solution through a capillary needle or from the surface of a layer of liquid precursor on an electrode surface while applying an electric field (DC or AC) to form a propagating polymer jet. High voltage causes the solution to form a cone, and from the tip of this cone a fluid jet is ejected and accelerated towards a collector. The elongating jet is thinned as solvent evaporates, resulting in a continuous solid fiber. Fibers are then collected on the collector.

The utilization of non-capillary (needle-less, free-surface, slit, wire, cylinder) fiber-generating electrodes increases the process productivity due to the simultaneous generation of multiple jets, but at the cost of the higher voltage that is needed for the process. The application of a periodic, alternating electric field (AC-electrospinning), instead of common static field (DC-electrospinning), improves the conditions for fiber generation due to the increased effect of the "corona" or "ionic" wind phenomenon that efficiently carries away the produced fibers. AC-electrospinning exhibits a high fiber generation rate per electrode area, high process productivity, and easier handling of fibers in comparison to DC-electrospinning. However, the periodic nature of AC-electrospinning can strongly restrict the spinnability of many precursor solutions due to the stronger field's confinement to the fiber-generating electrode and changes in the properties of the precursors.

SUMMARY

The present disclosure is directed to an electrode system for use in an AC-electrospinning system and an AC-electrospinning method. The electrode system comprises an electrical charging component electrode and at least one of an AC field attenuating component and a precursor liquid attenuating component. The electrical charging component electrode is electrically coupled to an AC source that delivers an AC signal to the electrical charging component electrode to place a predetermined AC voltage on the electrical charging component electrode.

In accordance with an embodiment, the electrode system comprises the AC field attenuating component, but not the precursor liquid attenuating component, and the predetermined AC voltage is also placed on the AC field attenuating component. The AC field attenuating component attenuates an AC field created by the placement of the predetermined AC voltage on the electrical charging component electrode.

In accordance with an embodiment, the electrical charging component electrode is doughnut-shaped. In accordance with another embodiment, the electrical charging component electrode is disk-shaped.

In accordance with an embodiment, the electrical charging component electrode has a top surface and a rim or lip that together define a reservoir for holding precursor liquid such that the top surface of the electrical charging component electrode serves as a bottom of the reservoir.

In accordance with an embodiment, the AC field attenuating component is a ring. In accordance with an embodiment, the ring is round in shape. In accordance with an embodiment, the ring is rectangular in shape.

In accordance with an embodiment, the AC field attenuating component is adjustable in at least one of position, orientation and tilt relative to the electrical charging component electrode.

In accordance with an embodiment, the electrode system comprises the precursor liquid attenuating component, but not the AC field attenuating component, and the electrical charging component electrode has a top surface and a rim or lip that together define a reservoir for holding precursor liquid such that the top surface of the electrical charging component electrode serves as a bottom of the reservoir. The precursor liquid attenuating component facilitates fiber generation even in case where a level of the precursor liquid on the electrical charging component electrode is below the lip or rim of the electrical charging component electrode.

In accordance with an embodiment, the precursor liquid attenuating component is cylindrically shaped. In accordance with an embodiment, the precursor liquid attenuating component is disk shaped. In accordance with another embodiment, the precursor liquid attenuating component is spherically shaped.

In accordance with an embodiment, the precursor liquid attenuating component is made of a non-electrically-conductive material having a relatively low dielectric constant.

In accordance with an embodiment, the precursor liquid attenuating component comes into contact with the precursor liquid and with the top surface of the electrical charging component electrode. In accordance with another embodiment, the precursor liquid attenuating component comes into contact with the precursor liquid and is in contact with or spaced apart from the top surface of the electrical charging component electrode. The precursor liquid attenuating component is rotated as it contacts the precursor liquid.

In accordance with an embodiment, the precursor liquid attenuating component is adjustable in position relative to the electrical charging component electrode.

In accordance with an embodiment, the electrode system comprises the precursor liquid attenuating component and the AC field attenuating component, and the predetermined AC voltage also being placed on the AC field attenuating component. The electrical charging component electrode has a top surface and a rim or lip that together define a reservoir for holding precursor liquid such that the top surface of the electrical charging component electrode serves as a bottom of the reservoir. The precursor liquid attenuating component facilitates fiber generation even in case where a level of precursor liquid on the electrical charging component electrode is below the lip or rim of the electrical charging component electrode.

The method comprises:

disposing a precursor liquid in a reservoir of an electrode system comprising an electrical charging component electrode and at least one of an AC field attenuating component and a precursor liquid attenuating component; and delivering an AC signal to the electrical charging component electrode from an AC source that is electrically coupled to the electrical charging component electrode to place a predetermined AC voltage on the electrical charging component electrode.

These and other features and advantages will become apparent from the following description, drawings and claims.

BRIEF DESCRIPTION OF THE DRAWINGS

FIGS. 3-6 depict examples of some of the possible electrode system configurations that use various arrangements components A, B and C.

FIGS. 7A and 7B show high-speed camera snap-shots of fibers generation during AC-electrospinning processes that use one of the electrode system configurations shown in FIGS. 3-6.

FIGS. 8A and 8B are side perspective views of two different electrode system configurations that comprise components A and B in accordance with a representative embodiment.

FIGS. 9A and 9B illustrate top plan views of two different electrode system configurations that can be configured with components A and B in accordance with representative embodiments.

FIG. 10 is a side perspective view of an electrode system configuration that comprises components A and B where component B is tilted relative to an axis of the electrode system configuration in accordance with a representative embodiment.

FIG. 11A is a side perspective view of an electrode system configuration comprising components A and B in accordance with a representative embodiment.

FIGS. 11B and 11C are photographs of the electrode system shown in FIG. 11A demonstrating the effect that the AC field attenuating component has on fiber generations when the AC field attenuating component is moved in a line with the liquid precursor fluid layer or slightly below it.

FIG. 12A is a side perspective view an electrode system configuration comprising the component A electrode and component C, the precursor liquid attenuating component, in accordance with a representative embodiment.

FIGS. 12B and 12C are photographs of an electrode system having the configuration shown in FIG. 12A, but with three rotating coaxial component C disks during the fibers generation process.

DETAILED DESCRIPTION OF AN ILLUSTRATIVE EMBODIMENT

Figure 1B:
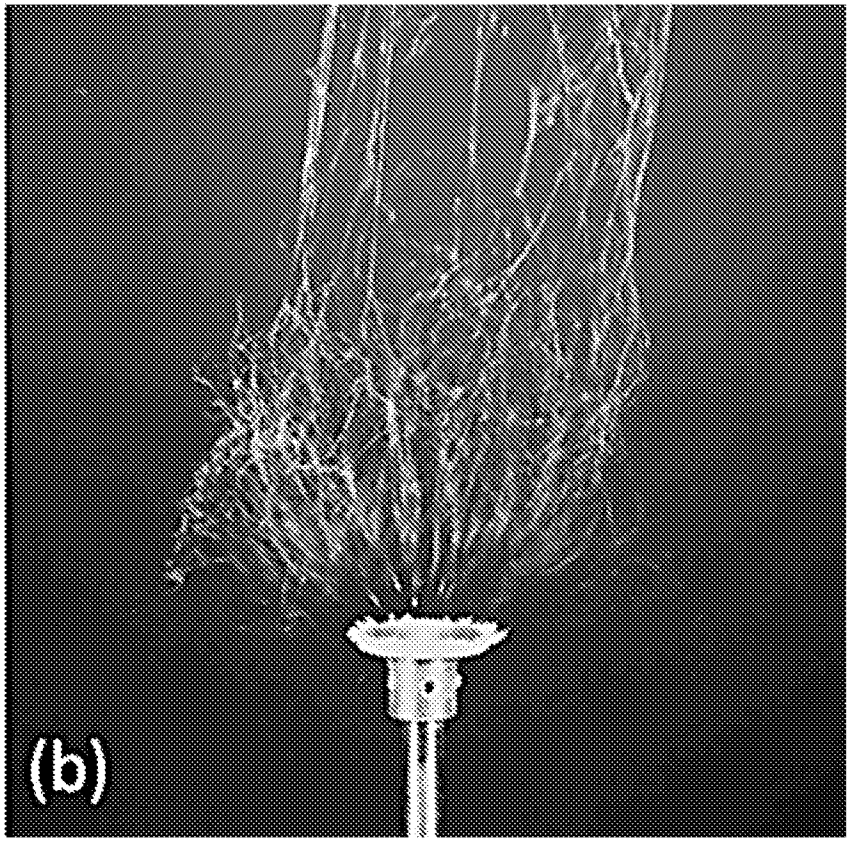
FIG. 1B (PRIOR ART)
FIGS. 1A and 1B illustrate high-speed camera snap-shots taken of fibers being generated by a known AC-electrospinning process with a base "common" electrode design within one minute and ten minutes after the start of the process, respectively.

Illustrative embodiments are disclosed herein of an electrode system for use in AC-electrospinning that reduces or eliminates the above limitations and restrictions, that significantly improves the productivity of the AC-electrospinning process and that broadens the applicability of the AC-electrospinning process. The electrode system comprises an electrical charging component electrode and at least one of an AC field attenuating component and a precursor liquid attenuating component. The electrical charging component electrode is electrically coupled to an AC source that delivers an AC signal to the electrical charging component electrode to place a predetermined AC voltage on the electrical charging component electrode. In cases in which the electrode system includes the AC field attenuating component, it attenuates the AC field generated by the electrical charging component electrode to better shape and control the direction of the fibrous flow. In cases in which the electrode system includes the precursor liquid attenuating component, it serves to increase fiber generation, even if the top surface of the liquid precursor is not ideally shaped or is below a rim or lip of the reservoir that contains the liquid on the electrical charging component electrode.

In the following detailed description, a few illustrative, or representative, embodiments are described to demonstrate the inventive principles and concepts. For purposes of explanation and not limitation, representative embodiments disclosing specific details are set forth in order to provide a thorough understanding of an embodiment according to the present teachings. However, it will be apparent to one having ordinary skill in the art having the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

The terminology used herein is for purposes of describing particular embodiments only, and is not intended to be limiting. As used in the specification and appended claims, the terms "a," "an," and "the" include both singular and plural referents, unless the context clearly dictates otherwise. Thus, for example, "a device" includes one device and plural devices. Relative terms may be used to describe the various elements' relationships to one another, as illustrated in the accompanying drawings. These relative terms are intended to encompass different orientations of the device and/or elements in addition to the orientation depicted in the drawings. It will be understood that when an element is referred to as being "connected to" or "coupled to" or "electrically coupled to" another element, it can be directly connected or coupled, or intervening elements may be present.

Exemplary, or representative, embodiments will now be described with reference to the figures, in which like reference numerals represent like components, elements or features. It should be noted that features, elements or components in the figures are not intended to be drawn to scale, emphasis being placed instead on demonstrating inventive principles and concepts.

Figure 1A:
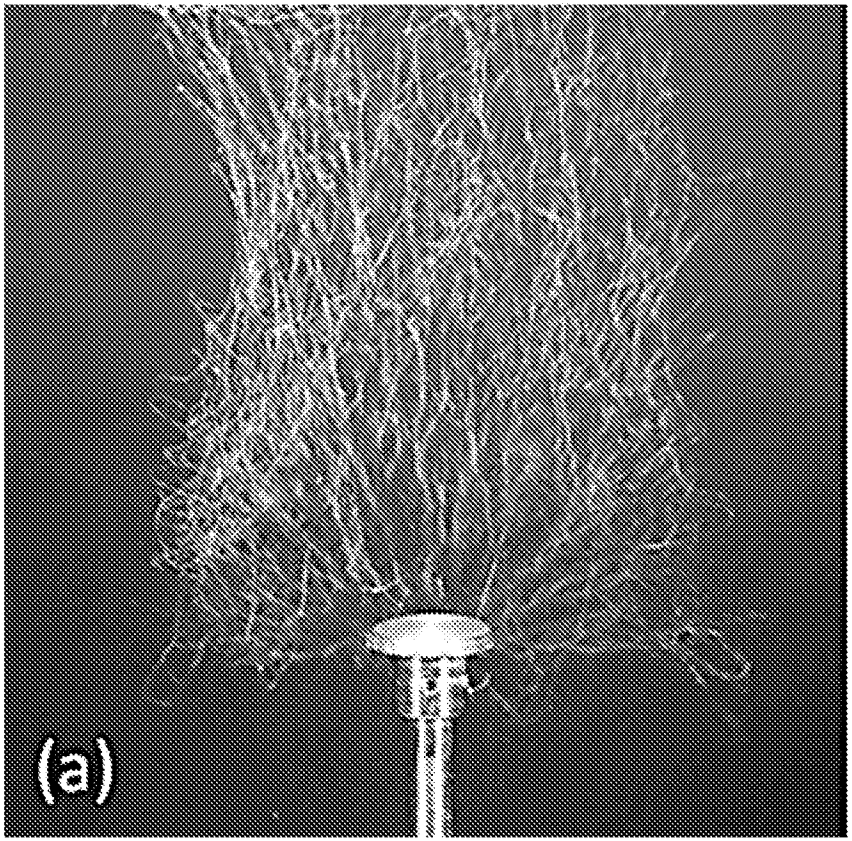
FIG. 1A (PRIOR ART)

FIGS. 1A and 1B illustrate high-speed camera snap-shots of fibers being generated by a known AC-electrospinning process that uses an electrode having a base "common" electrode design. The snap-shot shown in FIG. 1A was taken within a minute after the start of the AC-electrospinning process. The snap-shot shown in FIG. 1B was taken 10 minutes after the start of the known AC-electrospinning process. Although AC-electrospinning is a relatively new process for high-yield production of microfibers and nanofibers, two significant problems with the known AC-electrospinning process have been identified, namely: (1) the poor spinnability of many precursors in AC-electrospinning processes that normally have good spinnability in DC-electrospinning processes; and (2) the accumulation of spun material at the outer edge of the electrodes that are typically used in AC-electrospinning due to the high rate of fiber generation and due to confinement of the fibers to the electrode by the electric field distribution.

Problem (1) restricts the precursors that can be used in AC-electrospinning whereas problem (2) quickly reduces fiber production yield and eventually results in termination of fiber generation. The result of problem (2) is visible in FIG. 1B, which shows a white "crown" of spun material that has formed around the electrode's outer edge. The resulting reduction in the upward flow of fibers caused by accumulation of the spun material at the electrode's outer edge is evident from a comparison of FIGS. 1A and 1B.

The AC-electrospinning system and method in accordance with the present disclosure overcome these limitations and restrictions. The present disclosure provides an electrode system for use in an AC-electrospinning system and process that not only reduces or eliminates material accumulation on the outer edge of the electrode, but also allows fibers to be generated from precursors that are not spinnable or that are poorly spinnable with typical electrode designs currently used in AC-electrospinning processes. By achieving these goals, the productivity of the AC-electrospinning method is greatly improved while also achieving much better control of fiber generation and propagation.

Figure 2A:
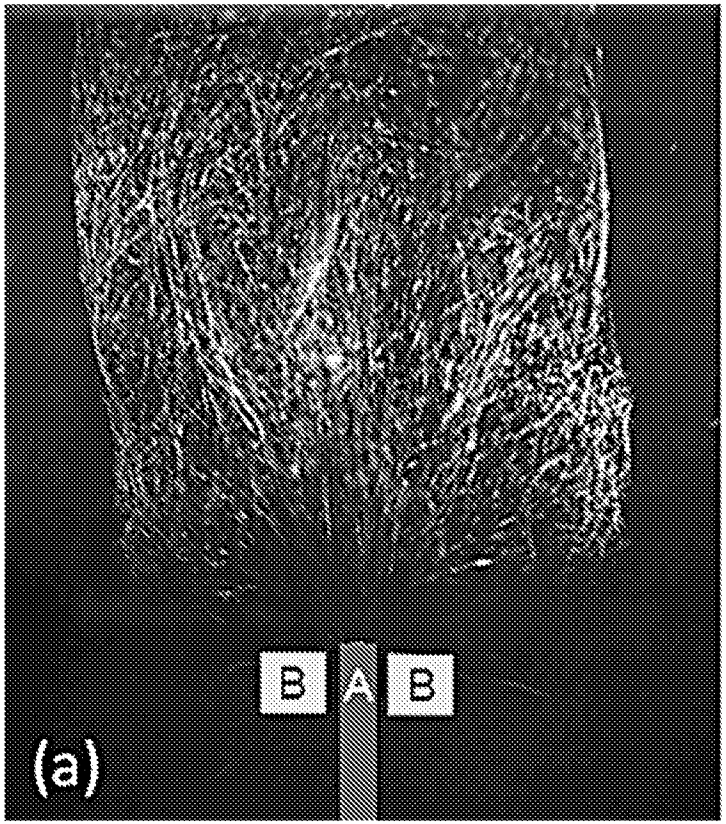
FIG. 2A shows a high-speed camera snap-shot of fibers generation during an AC-electrospinning process in accordance with a representative embodiment using a precursor X that is poorly-spinnable when used in known AC-electrospinning processes of the type depicted in FIGS. 1A and 1B.
Figure 2B:
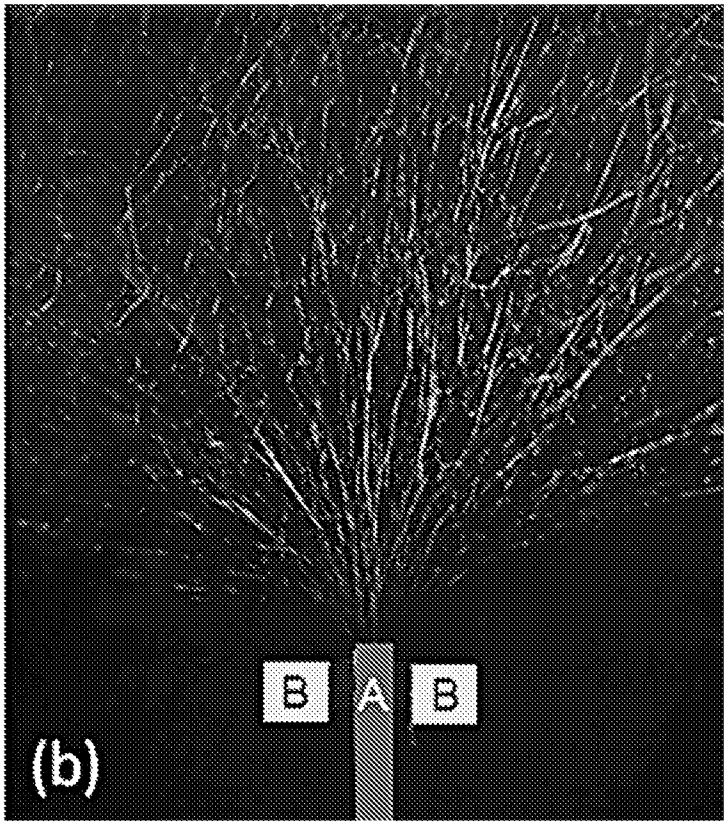
FIG. 2B shows a high-speed camera snap-shot of fibers generation during an AC-electrospinning process in accordance with a representative embodiment using a precursor Y that is poorly-spinnable when used in known AC-electrospinning processes of the type depicted in FIGS. 1A and 1B.

FIG. 2A shows a high-speed camera snap-shot of fibers generation during an AC-electrospinning process in accordance with a representative embodiment. The fibers shown in FIG. 2A were generated using a precursor X that is poorly-spinnable when used in known AC-electrospinning processes of the type that is depicted in FIGS. 1A and 1B. FIG. 2B shows a high-speed camera snap-shot of fibers generation during an AC-electrospinning process in accordance with a representative embodiment. The fibers shown in FIG. 2B were generated using a precursor Y that is a poorly-spinnable precursor when used in known AC-electrospinning processes of the type that is depicted in FIGS. 1A and 1B.

In the representative embodiments shown in FIGS. 2A and 2B, a new electrode comprising components labeled A and B was used in the AC-electrospinning system. The new electrode system can have a variety of configurations, as will be described below in more detail with reference to FIGS. 3-6. By using the new electrode system, the AC-electrospinning process achieves high spinnability using the previously poorly-spinnable precursors X and Y. In FIG. 2A, high spinnabality of precursor X fibers has been reached with a uniform columnar fiber flow. In FIG. 2B, cone-like flow of precursor Y fibers is attained. To provide some idea of the scale of fibers generation, the width of the photos shown in FIGS. 2A and 2B is about 250 millimeters (mm). It should be noted that the inventive principles and concepts are not limited with regard to the precursors that are used in the AC-electrospinning process or with regard to the thicknesses of the generated fibers.

As indicated above, the electrode system of the present disclosure not only reduces or eliminates the material accumulation at the outer edge of the electrode, but also allows fibers to be generated from precursors that are not spinnable or that are poorly spinnable with typical electrode designs used in AC-electrospinning processes. Additionally, the electrode system of the present disclosure further increases AC-electrospinning productivity and allows much better control over fiber generation and propagation.

In accordance with a representative embodiment, the electrode system configuration comprises at least component A, and typically comprises component A and at least one of components B and C. Component A is an electrical charging component electrode. Component B is an AC field attenuating component. Component C is a precursor liquid attenuating component that is a rotating, non-electrically conductive component. In accordance with a preferred embodiment, when the electrode system configuration includes component A and at least one of components B and C, at least two of the components are arranged such that they have at least one common axis of symmetry.

The electrode system for AC-electrospinning in accordance with the inventive principles and concepts can have a variety of configurations, some of which are shown in FIGS. 3-6 and have the following attributes:

1) The electrode system configuration has an electrical charging component electrode (referred to interchangeably herein as "component A") and at least one of an AC field attenuating component (referred to interchangeably herein as "component B") and a precursor liquid attenuating component (referred to interchangeably herein as "component C") with at least one common axis of symmetry.

2) The components comprising the electrode system configuration, whether an A-B component configuration, an A-C component configuration, or A-B-C component configuration, are optimally located with respect to each other.

3) At least one of the components of the electrode system configurations having the attributes described above in 1) is non-electrically conductive.

4) All of the components of the electrode system configurations having the attributes described above in 1) can be moved relative to each other with at least one degree of freedom (either translation or rotation).

5) At least one of the components of the electrode system configuration having the attributes described above in 1) includes a magnetic element. The magnetic element, however, may be present in any or all of components A, B and C for mechanical coupling of the parts to enable them to be quickly exchanged, thereby making the system more adaptable for different processes.

6) If the electrode system configuration having the attributes described above in 1) includes component C, component C is located in the primary direction of fiber generation (upward) and flow propagation with respect to component A.

7) If the electrode system configuration having the attributes described above in 1) includes component C, component C does not have direct electrical contact with either component A or with component B.

8) Any of the electrode system configurations having the attributes described above in 1) (A-B, A-C or A-B-C) can be grouped in a multi-electrode arrangement.

Examples of some of the possible electrode system configurations having at least some of the attributes given above in 1)-8) are shown in FIGS. 3-6. The electrode configuration shown in FIG. 3 has components A, B and C. Component B is located along a central axis 1 of the electrode system and has side walls that are surrounded by component A in the X-direction, also referred to herein as the lateral direction. Component B may be a circular ring, for example. Component B may be a solid element having a circular, cylindrical or rectangular cross-section. Component C is stacked on top of component A. Component C can have any shape that allows it to rotate, such as, for example, the shape of a cylinder, a ring, a sphere, a disc, etc. Component B may be recessed relative to component C, i.e., the Y-coordinate of B is smaller than the Y-coordinate of C. Components A and C may rotate relative to the central axis 1, which is parallel to the Y-axis of the X, Y, Z Cartesian coordinate system shown beneath FIGS. 3-6. Component B may be movable along the central axis 1.

The electrode system configuration shown in FIG. 3 can be modified in a number of ways. For example, component C shown in FIG. 3 may be eliminated leaving the electrode system with an A-B configuration. As another example, component B shown in FIG. 3 may be eliminated leaving the electrode system with an A-C configuration. In all cases, in the configuration shown in FIG. 3, central axis 1 is a common axis for all of the components, regardless of whether the electrode system configuration has an A-B, A-C or A-B-C configuration. Thus, the system configuration shown in FIG. 3 has attribute 1). Whichever components are used to form the electrode system configuration shown in FIG. 3, the components can be optimally located relative to one another, which meets attribute 2). At least one of the components can be electrically non-conductive to meet attribute 3). All of the components making up the configuration of FIG. 3 can be moved relative to each other with at least one degree of freedom to meet attribute 4). For example, components A and C may rotate relative to the central axis 1 while component B may be movable along the central axis 1. At least one of components A, B or C can be a magnetic element to meet attribute 5). In FIG. 3, component C is located in the primary direction of fiber generation and flow propagation to meet attribute 6). Component C is spaced apart from components A and B so that there is no direct electrical connection between component C and components A and B, which meets attribute 7. This attribute can also be achieved by placing dielectric materials or spacers between components as needed. Multiple electrodes having the configuration shown in FIG. 3 can be grouped together to achieve a multi-electrode arrangement that meets attribute 8).

The electrode configuration shown in FIG. 4 has components A, B and C. Component A is located along a central axis 11 of the electrode system and has side walls that are surrounded by component B in the lateral directions. Component B may be a circular ring, for example. Component A may be a solid element having a circular, cylindrical or rectangular cross-section. Component C may also be a solid element having a circular, cylindrical or rectangular cross-section, and may be stacked on top of component A. Component B may rotate relative to the central axis 11, which is parallel to the Y-axis of the X, Y, Z Cartesian coordinate system shown beneath FIGS. 3-6. Components A and B may be movable along the central axis 11.

The electrode system configuration shown in FIG. 4 can be modified in a number of ways. For example, component C shown in FIG. 4 may be eliminated leaving the electrode system with an A-B configuration, which is essentially what is shown in FIGS. 2A and 2B, except that in FIGS. 2A and 2B, component A is protruding along the central axis 11 relative to component B. As another example, component B shown in FIG. 4 may be eliminated leaving the electrode system with an A-C configuration. In all cases, in the configuration shown in FIG. 4, central axis 11 is a common axis for all of the components, regardless of whether the electrode system configuration has an A-B, A-C or A-B-C configuration. Thus, the system configuration shown in FIG. 4 has attribute 1). Whichever components are used to form the electrode system configuration shown in FIG. 4, the components can be optimally located relative to one another, which meets attribute 2). Component C can be electrically non-conductive to meet attribute 3). Normally, components A and B are electrically conductive and component C is electrically non-conductive. All of the components making up the configuration shown in FIG. 4 can be moved relative to each other with at least one degree of freedom to meet attribute 4). For example, component B may rotate relative to the central axis 11 while components A and C may be movable along the central axis 11. At least one of components A, B or C can contain a magnetic element to meet attribute 5). In FIG. 4, component C is located in the primary direction of fiber generation and flow propagation to meet attribute 6). Component C is spaced apart from components A and B so that there is no direct electrical connection between component C and components A and B, which meets attribute 7. This attribute can also be achieved by placing dielectric materials or spacers between components as needed. Multiple electrodes having the configuration shown in FIG. 4 can be grouped together to achieve a multi-electrode arrangement that meets attribute 8).

The electrode configuration shown in FIG. 5 has components A, B and C. Components A and C are located along a central axis 21 of the electrode system and has one lateral side that is adjacent to component B. If component C is ring-shaped, it must rotate about its central axis normal to the plane of the ring. Component A may be a solid element having circular, cylindrical or ring-shaped cross-sections. Component C may be stacked on top of component A. Component B may move in the X-Z plane, for example. Components A and C may be movable along the central axis 21. Component B may be movable in the Y-direction parallel to the central axis 21. Components A and/or C may be movable in the X-Z plane perpendicular to the central axis 21.

The electrode system configuration shown in FIG. 5 can be modified in a number of ways. For example, component C shown in FIG. 5 may be eliminated leaving the electrode system with an A-B configuration. As another example, component B shown in FIG. 5 may be eliminated leaving the electrode system with an A-C configuration. In all cases, in the configuration shown in FIG. 5, central axis 21 is a common axis for at least components A and C. Thus, the system configuration shown in FIG. 5 has attribute 1). Whichever components are used to form the electrode system configuration shown in FIG. 5, the components can be optimally located relative to one another to meet attribute 2). At least one of the components shown in FIG. 5 can be electrically non-conductive to meet attribute 3). As described above, all of the components making up the configuration shown in FIG. 5 can be moved relative to each other with at least one degree of freedom to meet attribute 4). At least one of components A, B or C shown in FIG. 5 can be a magnetic element to meet attribute 5). In FIG. 5, component C is located in the primary direction of fiber generation and flow propagation to meet attribute 6). Component C is spaced apart from components A and B so that there is no direct electrical connection between component C and components A and B, which meets attribute 7. This attribute can also be achieved by placing dielectric materials or spacers between components as needed. Multiple electrodes having the configuration shown in FIG. 5 can be grouped together to achieve a multi-electrode arrangement that meets attribute 8).

The electrode configuration shown in FIG. 6 has components A, B and C. Component A is located along a central axis 31 of the electrode system and has side walls that are surrounded by component B in the lateral directions. Component A may be a circular ring, for example. The Component B that is located on the central axis 31 may be a solid element having a circular, cylindrical or rectangular cross-section. The component B that is the outermost component may be a ring, for example. Component C may be stacked on top of component A and rotate about its axis and/or move along the surface of component A. In such cases, component C can be cylindrically or spherically shaped. Components A and B that are ring-shaped may rotate relative to the central axis 31, which is parallel to the Y-axis of the X, Y, Z Cartesian coordinate system. Components A, B and C that are not ring-shaped may be movable along the axes that are parallel to the X-, Y- and/or Z-directions.

The electrode system configuration shown in FIG. 6 can be modified in a number of ways. For example, component C shown in FIG. 6 may be eliminated leaving the electrode system with an A-B configuration. As another example, component B shown in FIG. 6 may be eliminated leaving the electrode system with an A-C configuration. In all cases, in the configuration shown in FIG. 6, central axis 31 is a common axis for all of the components, regardless of whether the electrode system configuration has an A-B, A-C or A-B-C configuration. Thus, the system configuration shown in FIG. 6 has attribute 1). Whichever components are used to form the electrode system configuration shown in FIG. 6, the components can be optimally located relative to one another to meet attribute 2). At least one of the components shown in FIG. 6 can be electrically non-conductive to meet attribute 3). As described above, all of the components making up the configuration shown in FIG. 6 can be moved relative to each other with at least one degree of freedom to meet attribute 4). At least one of components A, B or C can be a magnetic element to meet attribute 5). In FIG. 6, component C is located in the primary direction of fiber generation and flow propagation to meet attribute 6). Component C is spaced apart from components A and B so that there is no direct electrical connection between component C and components A and B, which meets attribute 7. This attribute can also be achieved by placing dielectric materials or spacers between components as needed. Multiple electrodes having the configuration shown in FIG. 6 can be grouped together to achieve a multi-electrode arrangement that meets attribute 8). It should also be noted that electrode systems having the configurations shown in FIGS. 3-6, or modifications thereof, can be grouped together to form a multi-electrode arrangement.

Suitable materials for component A include, but are not limited to, metals and alloys with good resistance to common solvents, acids and bases. Stainless steel is an example of a suitable material for component A. Suitable materials for component B, which normally does not come into contact with fluids, include, but are not limited to, copper, aluminum and stainless steel metals and alloys with good resistance to common solvents, acids and bases. Suitable materials for component C, which is in contact with fluids, include, but are not limited to, Teflon, polypropylene, and other chemically-stable polymers with low dielectric constants.

FIGS. 7A and 7B show high-speed camera snap-shots of fibers generation during AC-electrospinning processes that use one of the new electrode system configurations described above with reference to FIGS. 3-6. FIGS. 8A and 8B are side perspective views of examples of different electrode system configurations that comprise components A and B. FIGS. 9A and 9B illustrate top plan views of examples of different electrode system configurations that can be configured with components A and B. With the configuration shown in FIG. 9A, component A is doughnut-shaped electrode and component B comprises an inner and outer electrode. With the configuration shown in FIG. 9B, component A is a disk-shaped electrode and component B comprises an outer electrode. It should be noted that the exemplary configurations shown in FIGS. 8A-9B are provided to demonstrate a few examples of the inventive principles and concepts and are not intended to be limiting, as will be understood by those of skill in the art in view of the description provided herein.

With any of these electrode system configurations, precursor fluid 3 is loaded onto a top surface of the component A electrode electrode. The precursor fluid 3 is typically pumped via a pump (not shown) through a tube 5 of the electrode system configuration to the top surface of the component A electrode. The same AC voltage is applied to the component A and B electrodes. Liquid jets are generated when the AC electric field is applied to the components A and B. As depicted in FIGS. 8A and 8B, fibers 4 form when the solvent in the precursor fluid 3 evaporates and the fibrous flow is drawn away for the component A electrode by the "ionic wind" phenomenon.

In many cases, in the absence of component B, the AC field attenuating component, the fibrous jets spread too much or they are difficult to initiate. Also, in the absence of component B, the fibrous residue mentioned above may form around the rim of the component A electrode. Component B is a field attenuating electrode that operates at the same AC voltage from the same source as the component A electrode. The field attenuating effect of component B improves fiber generation, improves the shape of the fibrous flow (FIG. 8B), and allows the flow direction to be controlled (FIGS. 7B and 8B). Component B is normally positioned around the component A electrode (FIG. 9A), but component B can also have an inner part (FIG. 9A) in the case of a hollow or doughnut-shaped component A electrode (FIG. 9A). In FIGS. 7A through 9B, component B is shown as being ring-shaped and circular. However, component B can have other shapes. For example, component B could have the shape of a rectangle (e.g., a square).

As shown in FIG. 10, component B can be tilted with respect to a center axis of the component A electrode that is coaxial with the tube 5 to control the flow direction. In some embodiments, a translation mechanism (not shown) mechanically coupled to component B allows a user to control the position, orientation and/or degree of tilt of component B to allow the field attenuating effect of component B to be adjusted to better control fiber generation, the shape of the fibrous flow and/or the direction of the fibrous flow.

FIG. 11A is a side perspective view an electrode system configuration comprising the component A electrode and component B in accordance with a representative embodiment. If the precursor fluid 3 does not have an optimum surface profile (convex) on the top surface of the component A electrode, jets are difficult to initiate or even impossible in some cases. If there is too much precursor fluid 3 on the top surface of the component A electrode, the fluid 3 can overflow the component A electrode and spill, requiring the AC-electrospinning process to be halted. On the other hand, if the fluid level is at or below the edge of the lip or rim of the component A electrode, as will be described below in more detail with reference to FIG. 14, jet generation typically ceases. Also, if component B is raised (in the +z direction) above the upper surface of the precursor fluid 3, as shown in FIG. 11A, jet generation typically ceases.

FIGS. 11B and 11C are photographs of the electrode system shown in FIG. 11A demonstrating the effect that the AC field attenuating component, component B, has on fiber generations when the AC field attenuating component B is moved in a line with the liquid precursor fluid layer 3 or slightly below it. As can be seen in FIGS. 11B and 11C, the jets are generated and the fibrous flow can be tuned in width, shape, and mass of fibers per minute produced by adjusting the height (z-direction) of component B relative to the component A electrode while keeping component B at or slightly below the z-position of the precursor fluid layer 3. The fibrous flow width, shape, and rate are determined by the electric filed voltage and frequency, and by the liquid precursor's composition, viscosity, electrical conductivity, and surface tension.

FIG. 12A is a side perspective view an electrode system configuration comprising the component A electrode and component C, the precursor liquid attenuating component, in accordance with a representative embodiment. FIGS. 12B and 12C are photographs of an electrode system having the configuration shown in FIG. 12A, but with three rotating coaxial component C disks during the fibers generation process. The addition of the precursor liquid attenuating component C, which is ideally made of low dielectric constant non-conductive material (e.g. Teflon or polypropylene, or other plastic), allows the problems described above with reference to FIG. 11A to be eliminated. In accordance with a representative embodiment, component C rotates and the electrically-charged precursor fluid 3 forms a layer on the surface of component C. The layer of precursor fluid 3 has a favorable convex shape that increases the number of jets produced per unit area, and therefore the fiber production rate increases. Thus, there is no longer a need to maintain an optimum level of precursor fluid 3 on the component A electrode, and therefore spills and residue accumulation around the component A electrode are prevented.

The precursor liquid attenuating component C can have a variety of shapes or configurations. For example, it can be a cylinder, a disk, a sphere, or a combination of thereof, and may have various surface profiles, such as, for example, a corrugated surface that modulates the fluid motion and further increases the jets production. The precursor liquid attenuating component C can be one or more cylinders, disks, or rings of different diameters and thickness (length). The precursor liquid attenuating component C can be partially immersed in the liquid precursor 3 and can be rotated at various speeds (w) in combination with linear x-y motion over the surface of the component A electrode. The working side of component C can be smooth or structured (e.g., having notches, holes, protrusions, etc.) to provide the retention of the liquid precursor 3. In the embodiment shown in FIGS. 12B and 12C, the rotating coaxial component C disks are plastic (e.g., Teflon) discs that are 30 mm in diameter with channels along their rims placed in a rectangular Teflon component A electrode that is partially filled with liquid precursor 3. When disc assembly rotates, fibers are produced from each side of the rim along each disc. In the exemplary configuration shown in FIGS. 12B and 12C, the length of the assembly comprising components A and C is 100 mm, although the inventive principles and concepts are not limited with respect to the dimensions of the assembly or its components.

The AC field-attenuating component B can be used together with component C. The x, y, z position of the component B electrode typically should be below the x, y, z position of the topmost surface of component C to better shape and direct the fibrous flow. Depending on the shape and areas of component A electrode and component C, component C may be moved in x-y directions while rotating. The bottom side of component C may slide on the top surface of the component A electrode as it rotates or it can be positioned slightly above the top surface of the component A electrode so that component C comes into contact with the precursor fluid 3 as component C rotates, but does not come into direct contact with the top surface of the component A electrode.

Figures 13, 14, 15:
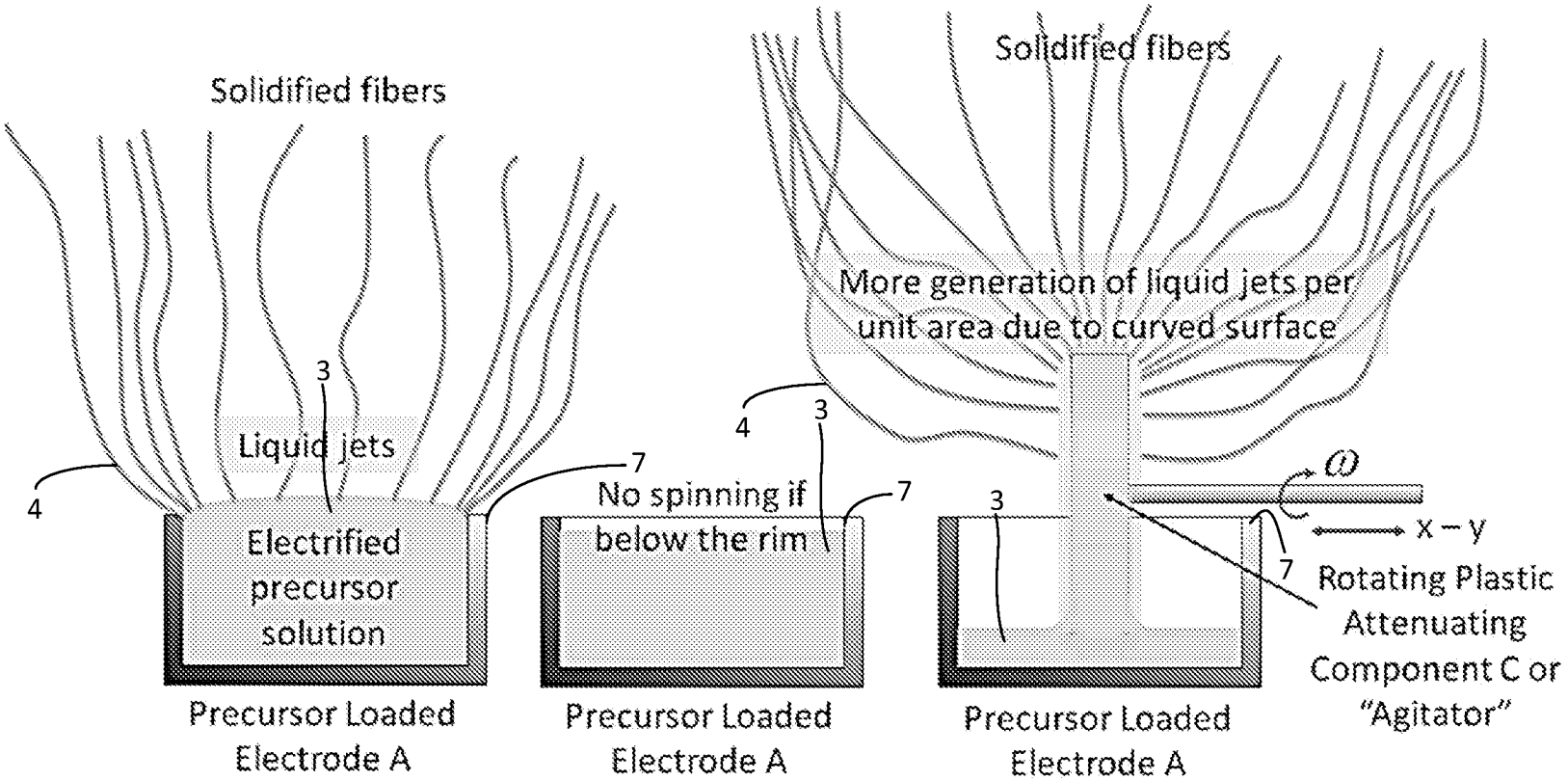
FIGS. 13-15 schematically illustrate fiber generation during AC-electrospinning for different configurations of the electrode system and different conditions of the precursor fluid relative to the component A electrode, in accordance with representative embodiments.

FIGS. 13-15 schematically illustrate fiber generation during the AC-electrospinning process for different configurations of the electrode system and different conditions of the precursor fluid 3 relative to the component A electrode in accordance with representative embodiments. The field-attenuating component B electrode is not included, although it could be. Normally, the component A electrode has a dish- or cup-like shape, as shown in FIGS. 13-15. The level of the precursor fluid 3 needed to affect the fiber generation and the proper convex surface profile of it (FIG. 13) are predicted. However, there are currently no numerical models that describe the possible development of Faraday's instability in a viscous fluid layer under an AC-field, and associated with it, the appearance of a surface wave pattern that can promote jet formation. In any case, when the level of fluid 3 drops below the rim 7 of the component A electrode, no jets are produced (FIG. 14). A rotating plastic disc or cylinder comprising component C draws fluid out of the component A electrode (FIG. 15), and this charged fluid 3, due to the curved surfaces of component C, can easily form multiple jets, and thus fibrous flow is produced. In addition, as indicated above, use of component C typically increases fiber generation over electrode system configurations that do not include component C (FIG. 13). Adding the component B electrode to the configurations shown in FIGS. 13 and 15 would provide better control over the shape and direction of the fibrous flow.

It should be noted that illustrative embodiments have been described herein for the purpose of demonstrating principles and concepts of the invention. As will be understood by persons of skill in the art in view of the description provided herein, many modifications may be made to the embodiments described herein without deviating from the scope of the invention. For example, while the inventive principles and concepts have been described primarily with reference to particular electrode system configurations, the inventive principles and concepts are equally applicable to other electrode system configurations. Also, many modifications may be made to the embodiments described herein without deviating from the inventive principles and concepts, and all such modifications are within the scope of the invention, as will be understood by those of skill in the art.

What is claimed is:

1. A method for performing alternating current (AC)-electrospinning, the method comprising:

disposing a precursor liquid in a reservoir of an electrode system comprising an electrical charging component electrode and at least one of an AC field attenuating component and a precursor liquid attenuating component; and delivering an AC signal to the electrical charging component electrode from an AC source that is electrically coupled to the electrical charging component electrode to place a predetermined AC voltage on the electrical charging component electrode.

2. An electrode system for use in an alternating current (AC)-electrospinning system, the electrode system comprising:

an electrical charging component electrode, the electrical charging component electrode being electrically coupled to an AC source that delivers an AC signal to the electrical charging component electrode to place a predetermined AC voltage on the electrical charging component electrode; and at least one of an AC field attenuating component and a precursor liquid attenuating component.

3. The electrode system of claim 2, wherein the predetermined AC voltage is also placed on the AC field attenuating component, and wherein the AC field attenuating component attenuates an AC field created by the placement of the predetermined AC voltage on the electrical charging component electrode.

4. The electrode system of claim 3, wherein the electrical charging component electrode is doughnut-shaped or disk-shaped.

5. The electrode system of claim 3, wherein the electrical charging component electrode has a top surface and a rim or lip that together define a reservoir for holding precursor liquid such that the top surface of the electrical charging component electrode serves as a bottom of the reservoir.

6. The electrode system of claim 3, wherein the AC field attenuating component is a ring.

7. The electrode system of claim 6, wherein the ring is round in shape or rectangular in shape.

8. The electrode system of claim 6, wherein the AC field attenuating component is adjustable in at least one of position, orientation and tilt relative to the electrical charging component electrode.

9. The electrode system of claim 2, wherein the electrode system comprises the precursor liquid attenuating component and the AC field attenuating component, the predetermined AC voltage also being placed on the AC field attenuating component, wherein the electrical charging component electrode has a top surface and a rim or lip that together define a reservoir for holding precursor liquid such that the top surface of the electrical charging component electrode serves as a bottom of the reservoir, and wherein the precursor liquid attenuating component facilitates fiber generation even in case where a level of precursor liquid on the electrical charging component electrode is below the lip or rim of the electrical charging component electrode.

10. The electrode system of claim 9, wherein the precursor liquid attenuating component is cylindrically shaped, disk shaped, or spherically shaped.

11. The electrode system of claim 9, wherein the precursor liquid attenuating component is made of a non-electrically-conductive material having a relatively low dielectric constant.

12. The electrode system of claim 9, wherein the precursor liquid attenuating component comes into contact with the precursor liquid and with the top surface of the electrical charging component electrode.

13. The electrode system of claim 9, wherein the precursor liquid attenuating component comes into contact with the precursor liquid and is in contact with or spaced apart from the top surface of the electrical charging component electrode.

14. The electrode system of claim 13, wherein the precursor liquid attenuating component is rotated as it contacts the precursor liquid.

15. The electrode system of claim 13, wherein the precursor liquid attenuating component is adjustable in position relative to the electrical charging component electrode.

16. The electrode system of claim 9, wherein two or more of the electrical charging component electrode, the precursor liquid attenuating component and the AC field attenuating component comprise magnets to facilitate quick and easy assembly and reconfiguration of the electrode system.

17. An electrode system for use in an alternating current (AC)-electrospinning system, the electrode system comprising:

an electrical charging component electrode, the electrical charging component electrode being electrically coupled to an AC source that delivers an AC signal to the electrical charging component electrode to place a predetermined AC voltage on the electrical charging component electrode; and a precursor liquid attenuating component, but not an AC field attenuating component, wherein the electrical charging component electrode has a top surface and a rim or lip that together define a reservoir for holding precursor liquid such that the top surface of the electrical charging component electrode serves as a bottom of the reservoir, and wherein the precursor liquid attenuating component facilitates fiber generation even in case where a level of the precursor liquid on the electrical charging component electrode is below the lip or rim of the electrical charging component electrode, wherein the precursor liquid attenuating component comes into contact with the precursor liquid and is in contact with or spaced apart from the top surface of the electrical charging component electrode or the precursor liquid attenuating component comes into contact with the precursor liquid and with the top surface of the electrical charging component electrode.

18. The electrode system of claim 17, wherein the precursor liquid attenuating component is cylindrically shaped, disk shaped, or spherically shaped.

19. The electrode system of claim 17, wherein the precursor liquid attenuating component is made of a non-electrically-conductive material having a relatively low dielectric constant.

20. The electrode system of claim 17, wherein the precursor liquid attenuating component is rotated as it contacts the precursor liquid.

21. The electrode system of claim 17, wherein the precursor liquid attenuating component is adjustable in position relative to the electrical charging component electrode.

* * * * *